US005969488A

United States Patent [19]

Fromson

[11] Patent Number: 5,969,488

[45] Date of Patent: Oct. 19, 1999

[54] REMOTELY-CONTROLLABLE BED SYSTEM

[75] Inventor: Leonard E. Fromson, Cerritos, Calif.

[73] Assignee: Maxwell Products, Inc., Cerritos, Calif.

[21] Appl. No.: 08/688,709

[22] Filed: Jul. 31, 1996

Related U.S. Application Data

[62] Division of application No. 08/189,963, Jan. 31, 1994, Pat. No. 5,544,376.

[51] Int. Cl.[6] ..... H04Q 7/06; G61G 7/015

[52] U.S. Cl. ..... 318/16; 5/618

[58] Field of Search ..... 318/16, 264, 265, 318/266, 286, 466, 467, 468; 5/613, 616, 617, 618, 619, 915

[56] References Cited

U.S. PATENT DOCUMENTS 4,682,088 7/1987 Sullivan ..... 318/568
4,845,415 7/1989 Steely ..... 318/568.1
5,197,007 3/1993 Parker ..... 318/466 X
5,235,258 8/1993 Schuerch ..... 318/16
5,437,608 8/1995 Cutler ..... 601/49

*Primary Examiner*—Bentsu Ro
*Attorney, Agent, or Firm*—Oppenheimer Poms Smith

[57] ABSTRACT

A vibratory, motorized articulated bed including a head motor, a foot motor and a vibratory massage motor, is controlled by a remote control hand-held device. The device has (a) a first user-activated mechanism which controls an operation of at least one of the head and foot motors and (b) a second user-activated mechanism which shifts an on-off cycling rhythm of the massage motor between first and second different rhythms with the massage motor running. According to another aspect of the invention, a control circuit remotely operable by a user of the bed is provided. The control circuit includes (a) a user memory which stores a remotely-communicated user variable to indicate a user-selected preferred position of the bed, (b) a recall control by which the user can remotely command the bed to be returned to the preferred position, and (c) a handler routine which is responsive to the recall control and which returns the bed to the preferred position.

15 Claims, 7 Drawing Sheets

REMOTELY-CONTROLLABLE BED SYSTEM

CROSS-REFERENCE TO RELATED APPLICATION

This is a divisional of application Ser. No. 08/189,963, filed Jan. 31, 1994, which issued on Aug. 13, 1996, as U.S. Pat. No. 5,544,376.

BACKGROUND OF THE INVENTION

The present invention relates to articulated beds adjustable by electric motors or their equivalent to support the person in the bed in different positions as desired, and more specifically to beds that can be operated by a handheld unit coupled to the bed by a wire or wireless link.

Although adjustable beds have long been found useful in hospital and institutional settings, in recent years such beds have been made convenient for more universal use by adding lifting and vibrator massage motors controllable by a handheld controller. For example, U.S. Pat. No. 5,235,258 entitled REMOTELY CONTROLLED ARTICULATED BED describes an articulated bed manipulated by head and foot motors and vibrated by head and foot vibrator motors which are controlled by a wireless remote unit.

However, there is a danger that as more controllable features and options are added to such "automatic" beds they actually may become more difficult and frustrating to use. For example, if head and foot portions of the bed can be put in countless different positions and the head and foot vibrators can be set for a variety of speeds and massage patterns, the user may find it difficult to restore the bed to a favored setting once it has been readjusted for some reason. Moreover, if previously the bed has been left in a chair-like curved position, a tired or distraught person wanting to just lie on the bed in a more conventional position may not be in the mood to "play" with the controls.

Thus, it would be highly desirable if there were some way the user could easily make the bed automatically return to a favored "bed setting," without adding greatly to the cost of the bed or complexity in operating it. However, any mechanism which causes such a bed to automatically adjust its shape significantly might present a danger to a handicapped, sick or feeble person who inadvertently triggers the mechanism and cannot immediately bring it to a halt. Therefore, such a feature cannot be added without first devising some foolproof way for even a surprised or frightened person to easily halt any such automatic motion.

Accordingly, it is an object of the invention to provide an articulated bed and a method and device for operating it by which the user can customize several favorite settings of the bed's lifting and massaging motors and of even associated equipment, such as a bed lamp or television. A further object is to provide a safety mechanism by which even a surprised or frightened person can halt such an automatic adjustment motion of the bed.

SUMMARY OF THE INVENTION

In an articulated bed having a motor for raising and lowering the bed, a control circuit operated by the user has a first user memory for storing a first user variable indicating a user-selected first preferred bed position and a recall button by which the user can command that a handler routine in the control circuit return the bed to the first preferred bed position indicated by the first user variable. Further, the control circuit can have a tracking memory for frequently storing a tracking variable indicating the current position of the bed and a "store" or "program" button or control by which the user can command that the first user variable be set to equal the current tracking variable. Thus, any time the bed is in a position preferred by the user, the user can push the store button to store a user variable indicating the preferred bed position in the controller's memory; then afterwards the user can have the bed return to that preferred position by pressing the recall button.

Bed controllers usually have a number of control buttons for controlling different elements and functions of the bed. As a safety feature, whenever the bed is moving automatically in response to the recall button, pressing any button on the handheld controller halts and aborts the recall. Thus, even a user surprised or frightened by the "recall" movement of the bed will be able to halt the bed by pressing any key on the handheld control.

For storing the user's preferred "bed state," sufficient memory is provided for storing all of the user's preferred settings. For example, on a bed where the head and foot position, head and foot massage speed and pulse mode, and remote and bed-attached electric outlets are all controllable, all their settings are stored by pressing one program key (for example, labeled "p") and one memory location (for example, memory key 1); all the settings are recalled just by pressing the same memory location key (for example, memory key 1).

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
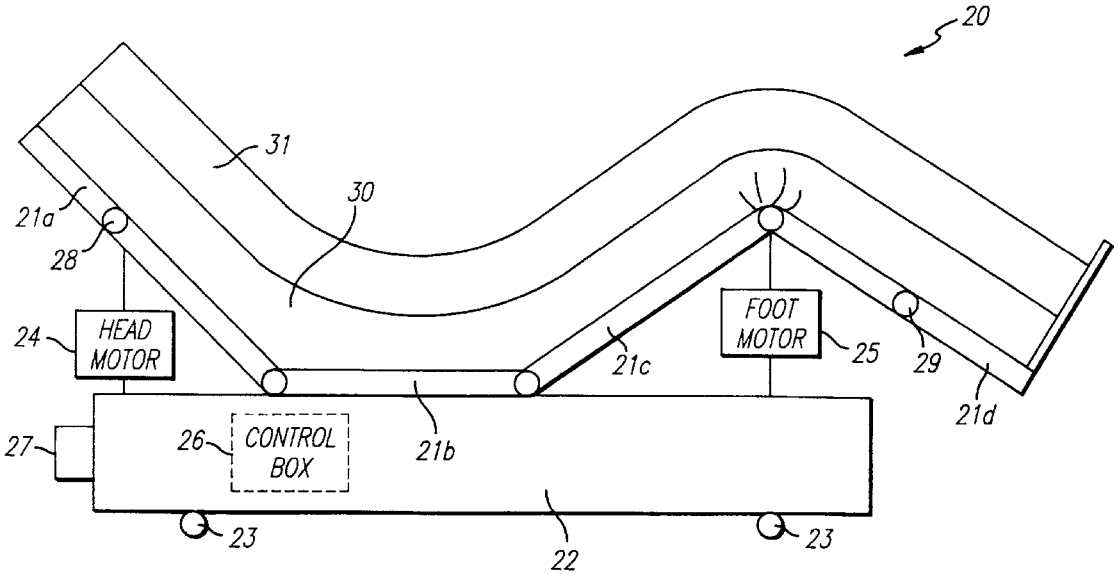
FIG. 1 is a simplified mechanical diagram showing a right side elevation of an embodiment of an articulated, motor-driven bed according to the invention.

As shown in the simplified mechanical diagram of FIG. 1, an articulated, motor-driven bed shown generally at 20 have an articulated support plate 21*a*, 21*b*, 21*c*, 21*d* is mounted on a base 22 having wheels or casters 23. Preferably the support plate is covered with a cloth-covered foam layer 30 and if desired a flexible mattress 31. The support plate is moved by electrical head and foot lifting motors 24 and 25, which are controlled by wire by an electrical circuit in a control box 26, attached to base 22, which responds to control signals from a handheld control. As will be seen below, the handheld control itself can be coupled to control box 26 by a wireless (radio or infrared) link.

An auxiliary box 27 having AC power sockets also controllable (ON/OFF, lamp dimming) by the handheld control for appliances, can also be wired to control box 26 and attached to bed base 22. Electrical head and foot vibrators (massage motors) 28, 29 respectively mounted on head (21*a*) and foot (21*d*) portions of the support plate can also be wired to control box 26 to regulate their ON/OFF times, speed, and pulse operation in response to user choices with the handheld control.

Figure 2:
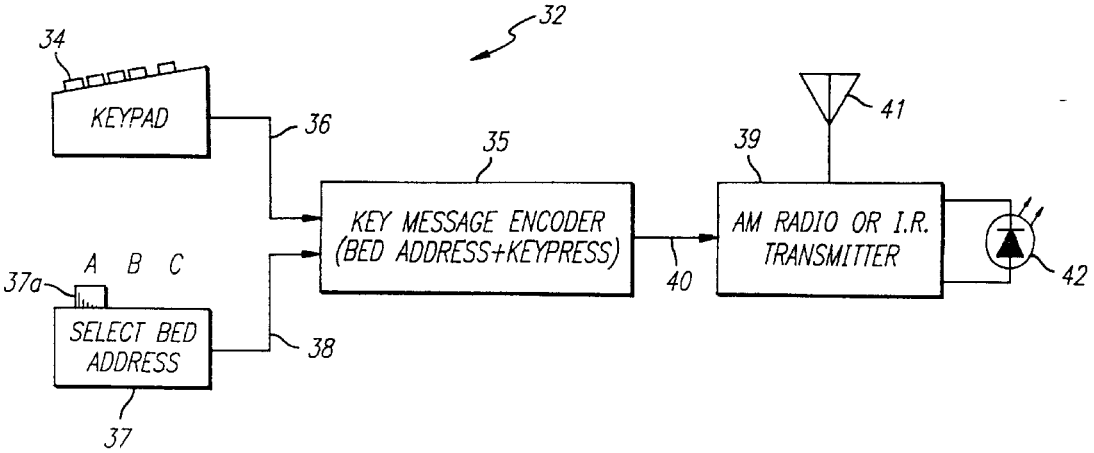
FIG. 2 is a block diagram of an embodiment of a handheld, wireless remote control transmitter unit for controlling the bed of FIG. 1.

The handheld, wireless remote control transmitter unit shown generally at 32 in FIG. 2 can be used to control the bed's lifting motors 24, 25 and vibration motors 28, 29 and auxiliary box 27 via control box 26. Transmitter unit 32 has a keypad 34 (also see FIG. 4) which the person controlling the bed (typically the person on the bed or the nurse) presses to generate electrical motor, vibrator, and auxiliary function command signals for bed control box 26. The command signals are input in parallel to a key message encoder 35 which incorporates a bed address (A, B, C) selected with switch 37*a* so each bed will only respond it its own corresponding transmitter. As will be seen below, the control box 26 on bed 20 also has an A, B, C address switch which can be set to match the address of its corresponding transmitter.

Encoder 35 can be a Motorola MC145026 encoder chip, in which case input lines from the keypad 34 are not simple binary, but can have one of three DC signal voltage states (High Voltage (H), Low Voltage (L), or Open Circuit (O)). As shown in Charts 2A–2C below, encoder 35 generates a unique nine-digit key code of H's, L's and O's corresponding to each key pressed. A bed with an "A" address can be programmed to recognize that only encoded key command signals from an Address A transmitter never have a Low (L) signal in lines 1 and 2. A bed with a "B" address can be programmed to recognize that an Address B transmitter always sends a Low (L) signal on line 1, whereas an Address C bed should look for the Low (L) signals an Address C transmitter puts on line 2.

Referring to FIG. 2, encoder 35 sends the encoded signals as a serial signal 40 to AM transmitter 39, which can be a conventional radio transmitter (for example, at three hundred MHZ) with antenna 41 or a conventional infrared transmitter 42.

Figure 3:
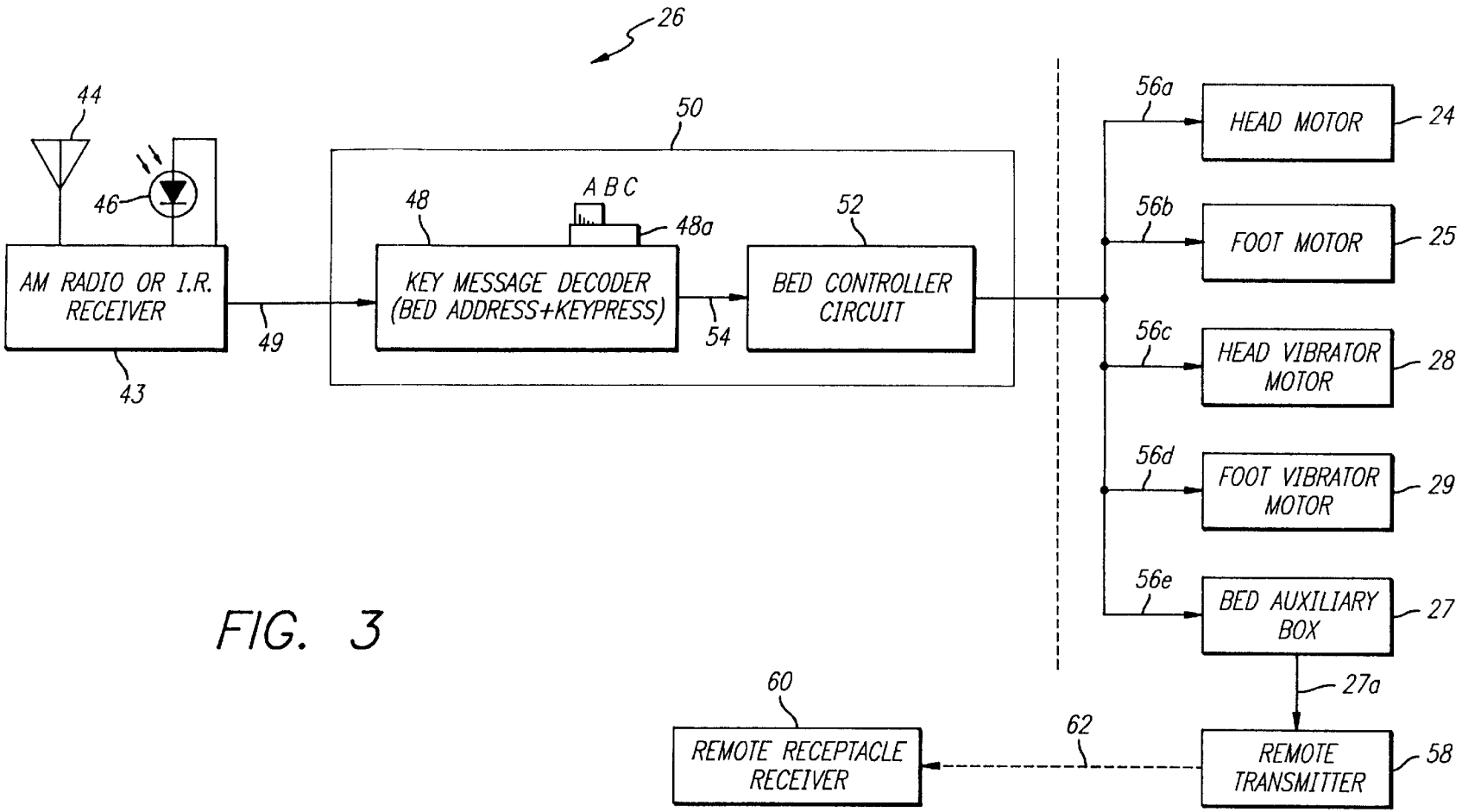
FIG. 3 is a block diagram of an embodiment of a remote control receiver unit according to the invention, mounted on the bed of FIG. 1 for receiving wireless control signals from the remote control transmitter of FIG. 2.

As shown in FIG. 3, the control box 26 of FIG. 1 has a corresponding AM radio or an infrared receiver 43 using a receiving antenna 44 or infrared-detecting diode 46. Receiver 43 demodulates the received command signals and passes them as a serial signal to a bed controller unit 50 which has a key message decoder 48 followed by a bed controller circuit 52. Key message decoder 48 on bed 20 is set to match the corresponding transmitter for A, B, or C bed addresses by an ABC switch 48*a*. The decoded key commands are input to bed controller circuit 52, which includes driver circuits (see FIG. 6) which enable the key commands to control head and foot motors 24, 25, head and foot vibrator motors 28, 29, and bed auxiliary box 27. Bed auxiliary box 27 can include a low frequency remote AM radio transmitter 58 (for example having a ten KHz carrier) which can pass control signals using the building electrical wiring 62 to a remote receptacle 60 plugged into an electrical socket elsewhere in the building in which the bed 20 is located.

Figure 4:
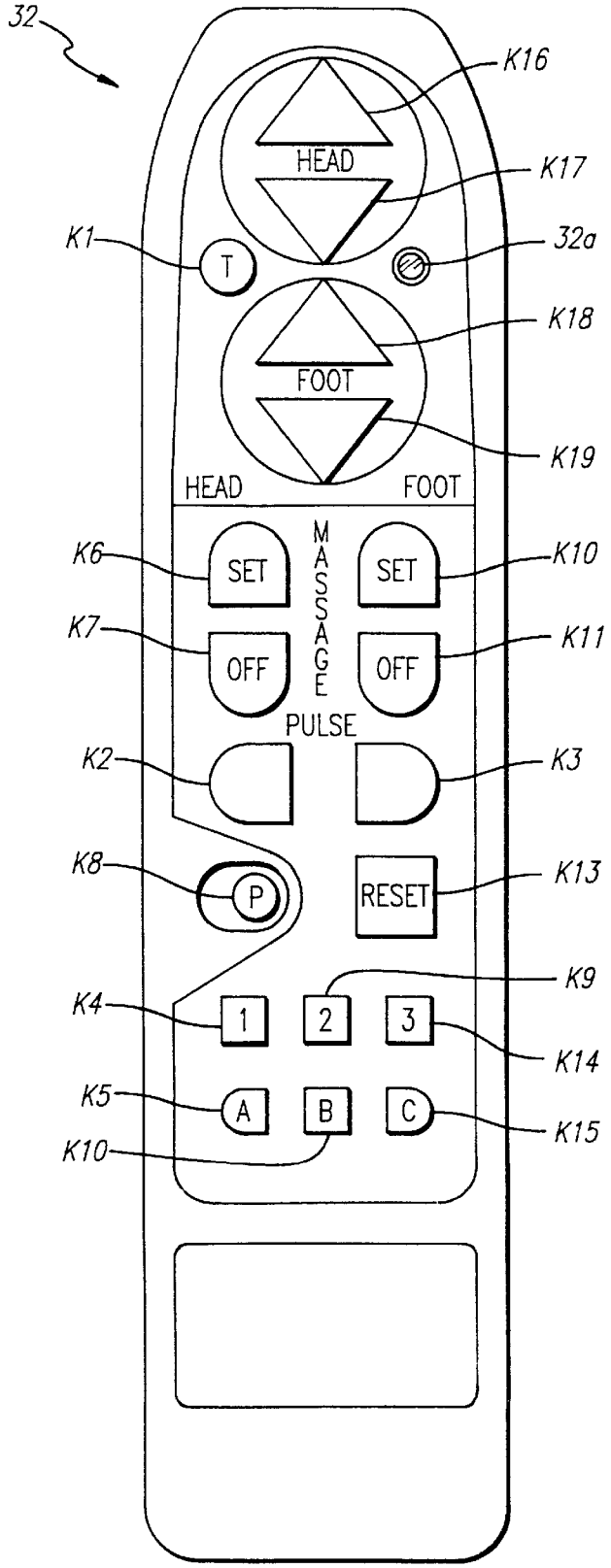
FIG. 4 is a face view of the handheld remote control transmitter unit of FIG. 2 showing the labeled control buttons.

As shown in FIG. 4, handheld remote control transmitter unit 32 having a power indicator light 32*a* has a number of specially labeled keys whose functions are summarized in Chart 1. The user can press a key to have the head motor 24 raise (K16) or lower (K17) the head 21 a portion of the bed, or to have the foot motor 25 raise (K18) or lower (K19) the foot portion 21*d* of the bed. A key (K1) labeled "T" for "timer" starts a thirty minute timer for the head and foot vibrator motors 28, 29, either of which can be shut off before the thirty minute interval ends by a corresponding OFF key (K7, K11). By successively pressing head and foot vibrator MASSAGE SET keys (K6, K10) the speed of the head and foot vibrator motors 28, 29 can be changed in the order HIGH, LOW and MEDIUM.

When vibrator motors 28, 29 are running, they can be shifted between preset pulse rhythms by successively pressing HEAD and FOOT MASSAGE PULSE keys (K2, K3). The available pulse rhythms are NORMAL (no pulsing) or pulsed intervals: FAST (two seconds ON, two seconds OFF), MEDIUM (four seconds ON, four seconds OFF), and SLOW (six seconds ON, six seconds OFF). A bed RESET key (K13) makes head and foot motors 24, 25 return the bed 20 to level and shuts off vibrator motors 28, 29.

CHART 1 - KEY COMMAND SCHEME

| KEY NAME | KEY # | VARIABLE AFFECTED | KEY EVENT | COMMAND |
|---|---|---|---|---|
| TIMER | K1 | TIME_REMAINING | PRESS DOWN | START MASSAGE (IF OFF) STOP MASSAGE (IF ON) |
| HEAD PULSE | K2 | Cur_Head_Massage_Pulse_Mode | PRESS DOWN | FAST ->MEDIUM ->SLOW ->NO_PULSE |
| FOOT PULSE | K3 | Cur_Foot_Massage_Pulse_Mode | PRESS DOWN | FAST ->MEDIUM ->SLOW ->NO_PULSE |
| MEMORY 1 | K4 | 1ST_BED_STATE (Memory Data Structure) | PRESS DOWN (Prog) | STORE CURRENT_BED_STATE |
| | | | PRESS DOWN (Recall) | RECALL 1ST___BED_STATE |
| AUX A (ALARM) | K5 | Cur_Remote_Alarm | PRESS DOWN | REMOTE ALARM ON/ REMOTE APPLIANCE ON |
| HD MASSAGE SET | K6 | Cur_Head_Massage_Speed | PRESS DOWN | SPEED: HIGH ->LOW ->MEDIUM |
| HD MASSAGE OFF | K7 | Cur_Head_Massage_Off | PRESS DOWN | HEAD MASSAGE OFF |
| PROGRAM | K8 | Program_Mode | PRESS DOWN | ENTER PROGRAM MODE |

-continued

CHART 1 - KEY COMMAND SCHEME

| KEY NAME | KEY # | VARIABLE AFFECTED | KEY EVENT | COMMAND |
|---|---|---|---|---|
| MEMORY2 | K9 | 2ND_BED_STATE (Memory Data Structure) | PRESS DOWN (Prog) | STORE CURRENT_BED_STATE |
| | | | PRESS DOWN (Recal) | RECALL 2ND_B EDSTATE |
| FT MASSAGE SET | K10 | Cur_Foot_Massage_Speed | PRESS DOWN | SPEED: HIGH ->LOW ->MEDIUM |
| FT MASSAGE OFF | K11 | Cur_Foot_Massage_Off | PRESS DOWN | FOOT MASSAGE OFF |
| RESET | K13 | Reset_Mode | PRESS DOWN | HEAD & FOOT TO LEVEL, MASSAGE MOTORS OFF |
| MEMORY3 | K14 | 3RD_BED_STATE (Memory Data Structure) | PRESS DOWN (Prog) | STORE CURRENT_BED_STATE |
| | | | PRESS DOWN (Recall) | RECALL 3RD_BED_STATE |
| AUX C (DIMMER) | K15 | Cur_C_Dimmer | PRESS DOWN | AUX OUTLET C: ON ->DIM ->DIMMER ->DIMMEST |
| HEAD UP | K16 | Cur_Head_Position | PRESS DOWN | HEAD MOTOR UP |
| HEAD DOWN | K17 | Cur_Head_Position | PRESS DOWN | HEAD MOTOR DOWN |
| FOOT UP | K18 | Cur_Foot_Position | PRESS DOWN | FOOT MOTOR UP |
| FOOT DOWN | K19 | Cur_Foot_Position | PRESS DOWN | FOOT MOTOR DOWN |
| AUX B (ON/OFF) | K10 | Cur_Aux_On | PRESS DOWN | AUX OUTLET B ON |

CHART 2A - KEY CODES FOR ADDRESS A

| | | KEY CODE | | | | | | | | |
|---|---|---|---|---|---|---|---|---|---|---|
| KEY NAME | KEY # | LINE 1 | LINE 2 | LINE 3 | LINE 4 | LINE 5 | LINE 6 | LINE 7 | LINE 8 | LINE 9 |
| TIMER | 1 | H | O | O | O | O | H | O | O | O |
| HEAD PULSE | 2 | O | H | O | O | O | H | O | O | O |
| FOOT PULSE | 3 | O | O | H | O | O | H | O | O | O |
| MEMORY 1 | 4 | O | O | O | H | O | H | O | O | O |
| AUX A (ALARM) | 5 | O | O | O | O | H | H | O | O | O |
| HD MASSAGE SET | 6 | H | O | O | O | O | O | H | O | O |
| HD MASSAGE OFF | 7 | O | H | O | O | O | O | H | O | O |
| PROGRAM | 8 | O | O | H | O | O | O | H | O | O |
| MEMORY 2 | 9 | O | O | O | H | O | O | H | O | O |
| FT MASSAGE SET | 10 | H | O | O | O | O | O | O | H | O |
| FT MASSAGE OFF | 11 | O | H | O | O | O | O | O | H | O |
| RESET | 13 | O | O | H | O | O | O | O | H | O |
| MEMORY 3 | 14 | O | O | O | H | O | O | O | H | O |
| AUX C (DIMMER) | 15 | O | O | O | O | H | O | O | H | O |
| HEAD UP | 16 | H | O | O | O | O | O | O | O | H |
| HEAD DOWN | 17 | O | H | O | O | O | O | O | O | H |
| FOOT UP | 18 | O | O | H | O | O | O | O | O | H |
| FOOT DOWN | 19 | O | O | O | H | O | O | O | O | H |
| AUX B (ON/OFF) | 10 | O | O | O | O | H | O | O | O | H |

CHART 2B - KEY CODES FOR ADDRESS B

| | | KEY CODE | | | | | | | | |
|---|---|---|---|---|---|---|---|---|---|---|
| KEY NAME | KEY # | LINE 1 | LINE 2 | LINE 3 | LINE 4 | LINE 5 | LINE 6 | LINE 7 | LINE 8 | LINE 9 |
| TIMER | 1 | L | O | O | O | O | H | O | O | O |
| HEAD PULSE | 2 | L | H | O | O | O | H | O | O | O |
| FOOT PULSE | 3 | L | O | H | O | O | H | O | O | O |
| MEMORY 1 | 4 | L | O | O | H | O | H | O | O | O |
| AUX A (ALARM) | 5 | L | O | O | O | H | H | O | O | O |
| HD MASSAGE SET | 6 | L | O | O | O | O | O | H | O | O |
| HD MASSAGE OFF | 7 | L | H | O | O | O | O | H | O | O |
| PROGRAM | 8 | L | O | H | O | O | O | H | O | O |
| MEMORY 2 | 9 | L | O | O | H | O | O | H | O | O |
| FT MASSAGE SET | 10 | L | O | O | O | O | O | O | H | O |
| FT MASSAGE OFF | 11 | L | H | O | O | O | O | O | H | O |
| RESET | 13 | L | O | H | O | O | O | O | H | O |
| MEMORY 3 | 14 | L | O | O | H | O | O | O | H | O |

-continued

CHART 2B - KEY CODES FOR ADDRESS B

| KEY NAME | KEY # | KEY CODE LINE 1 | LINE 2 | LINE 3 | LINE 4 | LINE 5 | LINE 6 | LINE 7 | LINE 8 | LINE 9 |
|---|---|---|---|---|---|---|---|---|---|---|
| AUX C (DIMMER) | 15 | L | O | O | O | H | O | O | H | O |
| HEAD UP | 16 | L | O | O | O | O | O | O | O | H |
| HEAD DOWN | 17 | L | H | O | O | O | O | O | O | H |
| FOOT UP | 18 | L | O | H | O | O | O | O | O | H |
| FOOT DOWN | 19 | L | O | O | H | O | O | O | O | H |
| AUX B (ON/OFF) | 10 | L | O | O | O | H | O | O | O | H |

CHART 2C - KEY CODES FOR ADDRESS C

| KEY NAME | KEY # | KEY CODE LINE 1 | LINE 2 | LINE 3 | LINE 4 | LINE 5 | LINE 6 | LINE 7 | LINE 8 | LINE 9 |
|---|---|---|---|---|---|---|---|---|---|---|
| TIMER | 1 | H | L | O | O | O | H | O | O | O |
| HEAD PULSE | 2 | O | L | O | O | O | H | O | O | O |
| FOOT PULSE | 3 | O | L | H | O | O | H | O | O | O |
| MEMORY 1 | 4 | O | L | O | H | O | H | O | O | O |
| AUX A (ALARM) | 5 | O | L | O | O | H | H | O | O | O |
| HD MASSAGE SET | 6 | H | L | O | O | O | O | H | O | O |
| HD MASSAGE OFF | 7 | O | L | O | O | O | O | H | O | O |
| PROGRAM | 8 | O | L | H | O | O | O | H | O | O |
| MEMORY 2 | 9 | O | L | O | H | O | O | H | O | O |
| FT MASSAGE SET | 10 | H | L | O | O | O | O | O | H | O |
| FT MASSAGE OFF | 11 | O | L | O | O | O | O | O | H | O |
| RESET | 13 | O | L | H | O | O | O | O | H | O |
| MEMORY 3 | 14 | O | L | O | H | O | O | O | H | O |
| AUX C (DIMMER) | 15 | O | L | O | O | H | O | O | H | O |
| HEAD UP | 16 | H | L | O | O | O | O | O | O | H |
| HEAD DOWN | 17 | O | L | O | O | O | O | O | O | H |
| FOOT UP | 18 | O | L | H | O | O | O | O | O | H |
| FOOT DOWN | 19 | O | L | O | H | O | O | O | O | H |
| AUX B (ON/OFF) | 10 | O | L | O | O | H | O | O | O | H |

Figure 5:
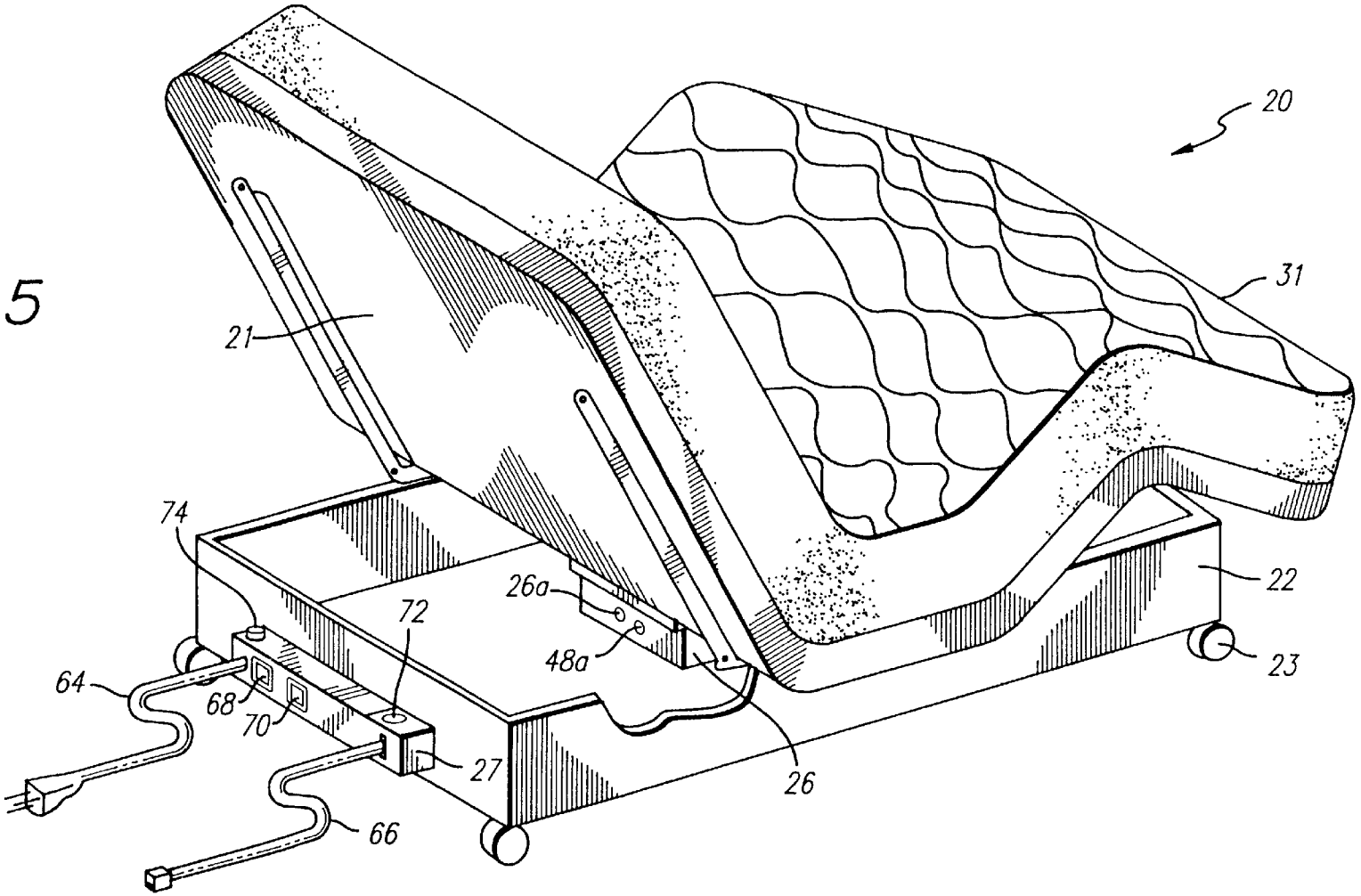
FIG. 5 is a more detailed, right rear perspective view of the motor-driven articulated bed of FIG. 1, showing how the remote control receiver of FIG. 2 and an auxiliary box can be mounted on the bed.

Another view of how control box 26 can be mounted under the bed 20 is shown in FIG. 5. Auxiliary box 27, which is attached at the rear of base 22, has its own AC power cord 64 and a low voltage control signal line 66 which plugs into a modular jack 26*a* on control box 26 to receive decoded key commands sent from handheld transmitter unit 32. As can be seen better in the block diagram of FIG. 8, auxiliary box 27 has an AC outlet 68 for an appliance and an AC outlet 70 which includes a dimmer for a lamp, both of which are controllable by the decoded key commands. An auxiliary ABC code switch 72 and a reset button 74 are also provided as shown in FIG. 5.

Figure 6:
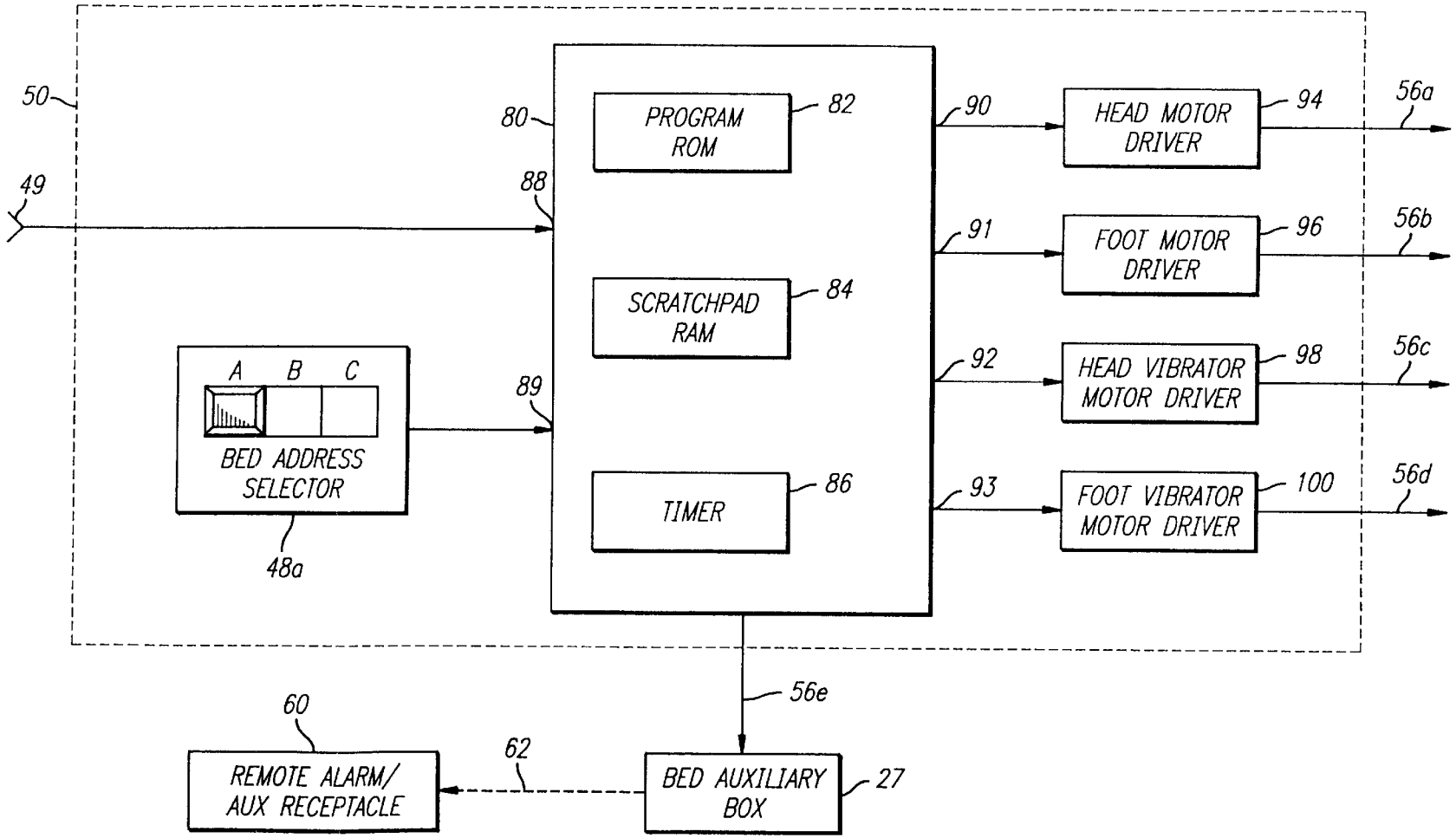
FIG. 6 is a detailed block diagram of a bed controller unit shown in the remote control receiver unit of FIG. 3.

FIG. 6 shows the computerized bed controller unit 50 which includes a programmed Intel LM80C22 microcomputer 80, which is similar to the Intel 8051 microcomputer. Microcomputer 80 has on board Read Only Memory (PROGRAM ROM) 82 for storing a control program (see FIG. 7) and a scratchpad read/write random access memory (SCRATCHPAD RAM) 84 for storing variables and scratchpad calculations. It also has an on-board timer 86, useful for measuring the thirty-minute run time for the vibrator motors 28, 29.

At terminal 89 Bed Address Selector 48*a* provides microcomputer 80 with a bed address selection (A, B, or C) set the same as the corresponding handheld transmitter's bed address. The received, demodulated encoded key messages are input on line 49 from receiver 43 to microcomputer terminal 88. Microcomputer 80 decodes the key command messages from the user and then at terminals 90, 91, 92, 93 sends appropriate digital control signals to driver circuits 94, 96, 98, 100 to control the head and foot motors 24, 25, head and foot vibrators 28, 29, and bed auxiliary box 27 to carry out the key commands.

Figure 7:
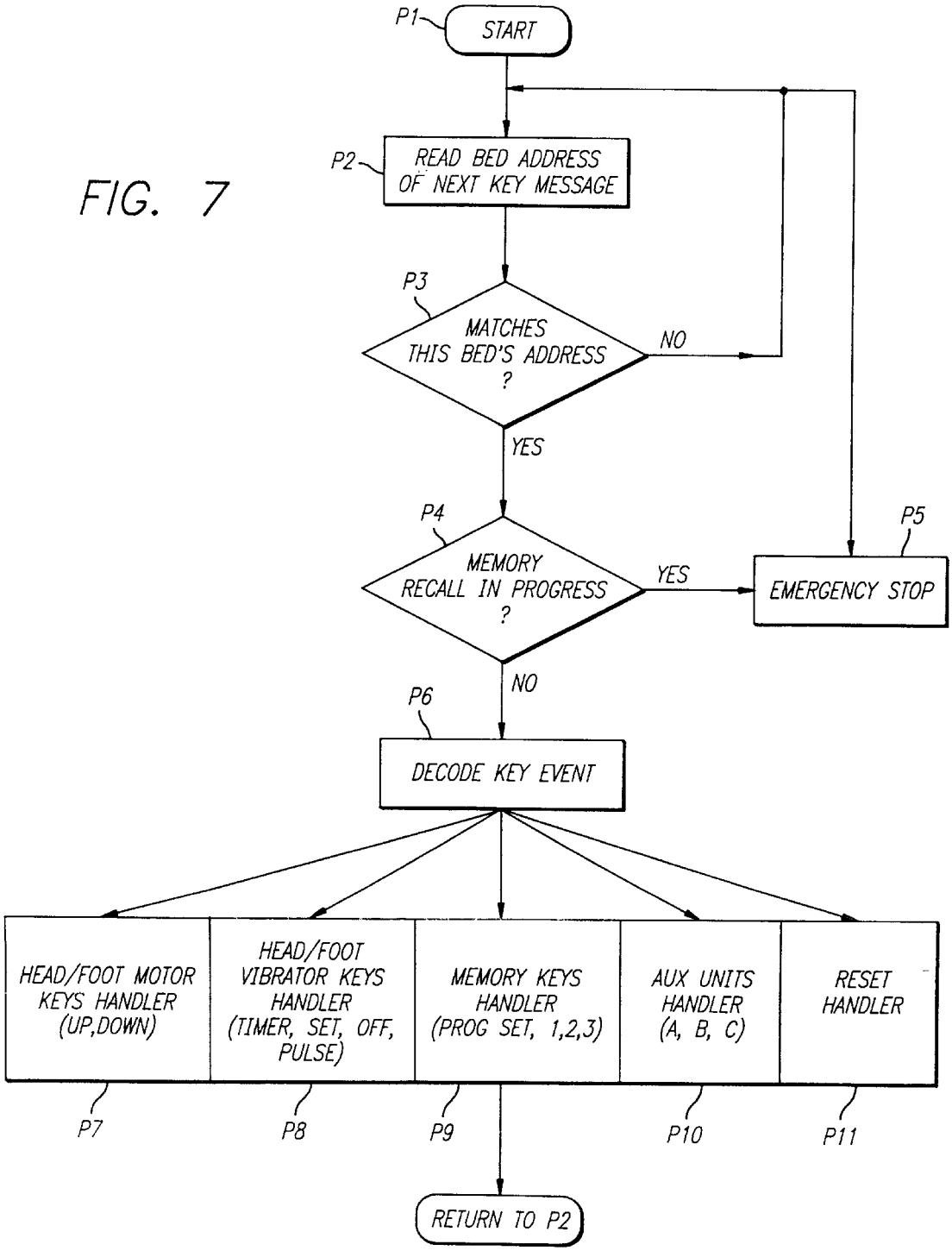
FIG. 7 is a flow chart of a control program for a microcomputer in the bed controller unit of FIG. 6.

FIG. 7 shows a flow chart of the controller program for microcomputer 80. At P2 the bed address of a key message is read and if at P3 the address does not match that of the microcomputer 80 the program loops back to P2 for the next message. If the bed address is correct at P3, a check is made at P4 to determine if the microcomputer is currently executing a memory recall. If it is, regardless of the key pressed, the microcomputer 80 performs an emergency stop at P5, and then loops back for the next message. If a memory recall is not in progress, the microcomputer 80 decodes the key command at P6 and then depending on the decoded command switches to an appropriate handler routine for the motors (P7), vibrators (P8), memory keys (P9), auxiliary units (P10), and bed reset function (P11). After the appropriate handler routine finishes, the program loops back to P2 for the next key message.

Chart 3 as set forth below is a chart of four memory structures (M1, M2, M3, M4) stored in a memory of the bed controller unit 50 of FIG. 6.

CHART 3
MEMORY DATA STRUCTURES

| CURRENT_BED_STATE: M1 | 1ST_BED_STATE: M2 |
|---|---|
| Cur_Head_Position | 1st_Head_Position |
| Cur_Foot_Position | 1st_Foot_Position |
| Cur_Head_Massage_Off | 1st_Head_Massage Off |
| Cur_Foot_Massage_Off | 1st_Foot_Massage_Off |
| Cur_Head_Massage_Speed | 1st_Head_Massage_Speed |
| Cur_Foot_Massage_Speed | 1st_Foot_Massage_Speed |
| Cur_Head_Massage_Pulse_Mode | 1st_Head_Massage_Pulse_Mode |
| Cur_Foot_Massage_Pulse_Mode | 1st_Foot_Massage_Pulse_Mode |
| Cur_A_Remote_A1arm | 1st_A_Remote_Alarm |
| Cur_B_Aux_On | 1st_B_Aux_On |
| Cur_C-Dimmer | 1 st_C-Dimmer |
| **2ND_BED_STATE: M3** | **3RD_BED_STATE: M4** |
| 2nd_Head_Position | 3rd_Head_Position |
| 2nd_Foot_Position | 3rd_Foot_Position |
| 2nd_Head_Massage_Off | 3rd_Head_Massage_Off |
| 2nd_Foot_Massage_Off | 3rd_Foot_Massage_Off |
| 2nd_Head_Massage_Speed | 3rd_Head_Massage_Speed |
| 2nd_Foot_Massage_Speed | 3rd_Foot_Massage_Speed |
| 2nd_Head_Massage_Pulse_Mode | 3rd_Head_Massage_Pulse_Mode |
| 2nd_Foot_Massage_Pulse_Mode | 3rd_Foot_Massage_Pulse_Mode |
| 2nd_A_Remote_Alarm | 3rd_A_Remote_Alarm |
| 2nd_B_Aux_On | 3rd_B_Aux_On |
| 2nd_C-Dimmer | 3rd_C-Dimmer |

As shown in Chart 3, the bed controller unit 50 includes an electronic random access memory (RAM) in which four memory data structures M1–M4 can each store a group of related variables indicating head and foot bed positions, head and foot massage (vibrator) ON/OFF states, speeds and pulse modes, and the states of three auxiliary devices. The RAM in which data structures M1–M4 are stored can be the scratchpad RAM 84 shown on board the microcomputer 80 of FIG. 6. The bed's three auxiliary devices are a remote alarm 60 controlled by the "A" key (K5) of handheld transmitter unit 32, an ON/OFF auxiliary outlet 68 controlled by the "B" key (K10), and a lamp dimmer outlet 70 controlled by the "C" key (K15).

A memory data structure is a collection of related variables stored in memory which, as a group, convey a particular meaning—here the total controllable state of the bed 20. Each time bed controller unit 50 adjusts the bed position, the vibrator settings, or the states of auxiliary devices 60, 68, 70 it updates memory data structure M1 so that the current values of the variables making up structure M1 indicate the current controllable state of bed 20 and its auxiliary devices.

When the user of handheld transmitter unit 32 presses its program key P (K8) followed by its "1" memory key (K4), bed controller unit 50 responds by setting the values of memory structure M2 equal to the current values of structure M1. Thus, structure M2 preserves a first bed state which can later be recalled simply by pressing the "1" memory key (K4) to control the bed 20 back to that state when the user presses the "1" memory key again. The "2" (K9) and "3" (K14) memory keys work in a similar manner to store second and third bed states for recall later.

As a safety feature, whenever any of the memory keys "1," "2," or "3" has been pressed to recall a previous bed state, pressing any button on the handheld controller halts and aborts the recall. Thus, even a user surprised or frightened by the "recall" movement of the bed 20 can easily halt the bed without a special STOP or EMERGENCY key.

Figure 8:
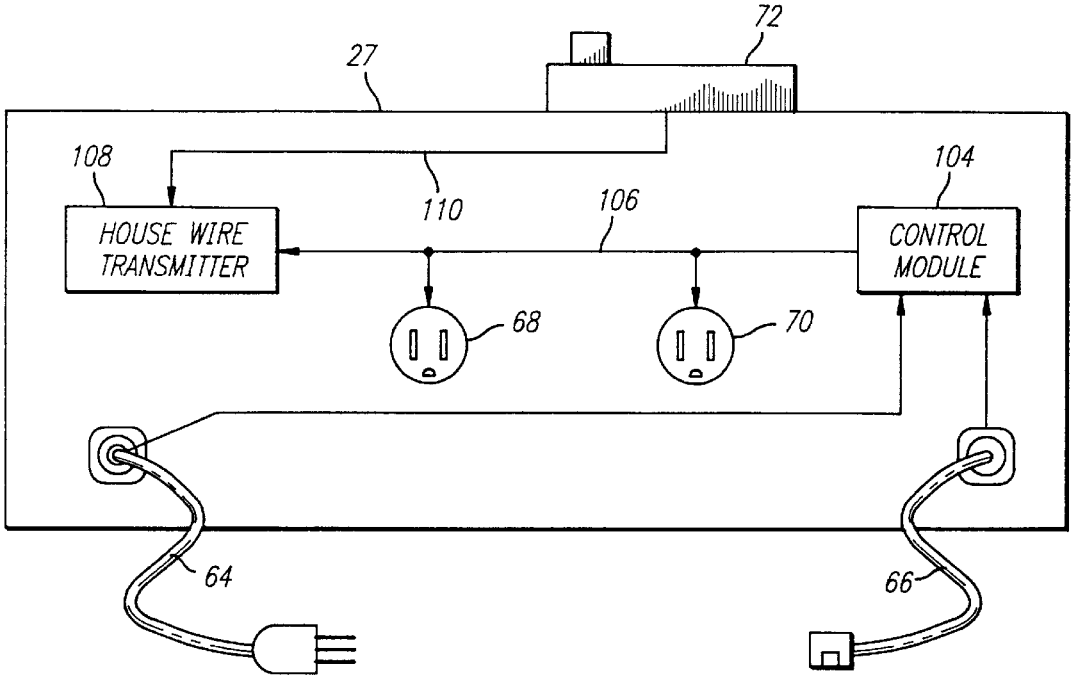
FIG. 8 is a front elevational view of the bed-mounted auxiliary box of FIG. 5.

FIG. 8 is a front elevational view of the bed-mounted auxiliary box 27 of FIG. 5. It shows a bed address switch ABC 72, AC outlet 68, AC outlet 70, AC power cord 64, signal line 66, control module 104, lines 106, 110 and house wire transmitter 108.

Figure 9:
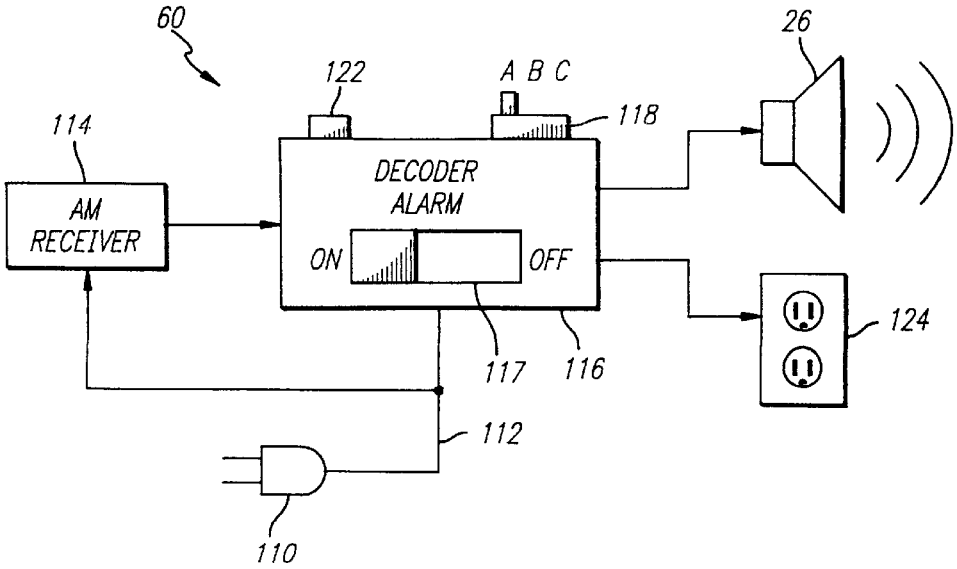
FIG. 9 is a block diagram of a controllable remote alarm/auxiliary receptacle box according to the invention, which is controlled by radio signals transmitted from the bed along the internal AC wires of the building.

FIG. 9 is a block diagram of a controllable remote alarm/auxiliary receptacle box according to the invention which is controlled by radio signals transmitted from the bed along the internal AC wires of the building. It shows AC line voltage at 110, line 112, AM receiver 114, decoder 116 with alarm 117 (having left and right "on" and "off" positions), ABC switch 118, reset 122, and auxiliary AC outlet 124.

While the present invention is described with reference to particular embodiments, those skilled in the art will recognize that many variations may be employed without departing from the spirit and scope of the invention as set forth in the claims. For example, the illustrated embodiments use a wireless handheld remote control transmitter unit 32, but the inventive memory and safety features would still be present if the transmitter were wired to control box 26. Similarly if the bed to be controlled has a different combination of lifting motors, vibrators and auxiliary units, the details of Memory Structures M1–M4 can be correspondingly modified while still employing the claimed invention.

In other words, from the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

I claim:

1. A remotely-controllable bed system, comprising:

a vibratory, motorized articulated bed including a head motor, a foot motor and a vibratory massage motor; and a remote control hand-held device including (a) a first user-activated mechanism which controls an operation of at least one of said head and foot motors and (b) a second user-activated mechanism which shifts an on-off cycling rhythm of said massage motor between first and second different rhythms with said massage motor running.

2. The remotely-controllable bed system of claim 1 wherein said remote control hand-held device includes a panel.

3. The remotely-controllable bed system of claim 2 wherein said first user-activated mechanism includes a key on said panel.

4. The remotely-controllable bed system of claim 2 wherein said first user-activated mechanism includes a first key on said panel for said head motor.

5. The remotely-controllable bed system of claim 4 wherein said first user-activated mechanism includes second key on said panel for said foot motor.

6. The remotely-controllable bed system of claim 2 wherein said first user-activated mechanism includes a key on said panel for said foot motor.

7. The remotely-controllable bed system of claim 2 wherein said second user-activated mechanism includes a key on said panel.

8. The remotely-controllable bed system of claim 1 wherein said massage motor defines a first massage motor, said bed includes a second massage motor, and said device includes a third user-activated mechanism which shifts an on-off cycling rhythm of said second massage motor between first and second different rhythms with said second massage motor running.

9. The remotely-controllable bed system of claim 8 wherein said device includes a panel, said second user-activated mechanism includes a first key on said panel and said third user-activated mechanism includes a second key on said panel.

10. The remotely-controllable bed system of claim 8 wherein said first massage motor is a head massage motor for a head portion of said bed, and said second massage motor is a foot massage motor for a foot portion of said bed.

11. The remotely-controllable bed system of claim 1 wherein said first rhythm is a no-pulsing rhythm, and said second rhythm is a pulsed interval rhythm.

12. The remotely-controllable bed system of claim 1 wherein said first rhythm is two seconds on and two seconds off, and said second rhythm is four seconds on and four seconds off.

13. The remotely-controllable bed system of claim 1 wherein said first rhythm is two seconds on and two seconds off, and said second rhythm is six seconds on and six seconds off.

14. The remotely-controllable bed system of claim 1 wherein said first rhythm is four seconds on and four seconds off, and said second rhythm is six seconds on and six seconds off.

15. The remotely-controllable bed system of claim 1 wherein said second user-activated mechanism shifts the on-off cycling rhythm between said first and second different rhythms and a third different rhythm.

* * * * *

UNITED STATES PATENT AND TRADEMARK OFFICE

CERTIFICATE OF CORRECTION

PATENT NO. : 5,969.488

DATED : October 19, 1999

INVENTOR(S) : Fromson

It is certified that error appears in the above-indentified patent and that said Letters Patent is hereby corrected as shown below:

In column 2, line 63, delete "bed shown generally at 20 have an articulated support plate" and insert -- bed shown generally at 20 has an articulated support plate -- .

In column 3, line 30, delete "so each bed will only respond it its own" and insert -- so each bed will only respond to its own -- .

In column 4, line 3, delete "(for example, at three hundred MHZ)" and insert -- (for example, at three hundred MHz) -- .

In column 4, line 29, delete "the head 21 a portion of the bed" and insert -- the head 21a portion of the bed -- .

In Chart 1, column 5 in the row pertaining to "Memory 2," in the "Command" column, delete "2ND_B EDSTATE" and insert -- 2ND_BEDSTATE -- .

In column 7, line 62, delete "Bed Address Selector 48a" and insert -- bed address Selector 48a -- .

In column 8, line 55, delete "depending on the decoded command switches to an appropriate handler routine" and insert -- depending on the decoded command, switches to an appropriate handler routine -- .

In Chart 3, column 9, line 13 of the column marked "CURRENT_BED_STATE," delete "Cur_A_Remote_A1arm" and insert -- Cur_A_Remote_Alarm -- .

In Chart 3, column 9, line 15 of the column marked "CURRENT_BED_STATE," delete "Cur_C-Dimmer" and insert -- Cur_C_Dimmer -- .

UNITED STATES PATENT AND TRADEMARK OFFICE

CERTIFICATE OF CORRECTION

PATENT NO. : 5,969.488

DATED : October 19, 1999

INVENTOR(S) : Fromson

It is certified that error appears in the above-indentified patent and that said Letters Patent is hereby corrected as shown below:

In Chart 3, column 9, line 28 of the column marked "CURRENT_BED_STATE," delete "2nd_C-Dimmer" and insert -- 2nd_C_Dimmer -- .

In Chart 3, column 9, line 15 of the column marked "1ST_BED_STATE," delete "1 st_C-Dimmer" and insert -- 1st_C_Dimmer -- .

In Chart 3, column 9, line 28 of the column marked "1ST_BED_STATE," delete "3rd_C-Dimmer" and insert -- 3rd_C_Dimmer -- .

Signed and Sealed this

Sixth Day of March, 2001

Nicholas P. Godici

*Attest:*

NICHOLAS P. GODICI

*Attesting Officer*

*Acting Director of the United States Patent and Trademark Office*